106-18.18 SR

1/28/86 XR 4,566,994

United States Patent [19]

Hasegawa et al.

[11] Patent Number: 4,566,994

[45] Date of Patent: Jan. 28, 1986

[54] FLAME-RETARDANT ELECTRICAL INSULATING OIL COMPOSITION

[75] Inventors: Hiroshi Hasegawa; Akira Shinzawa; Yoshiki Kohno, all of Yokohama, Japan

[73] Assignee: Nippon Oil Co., Ltd., Japan

[21] Appl. No.: 501,294

[22] Filed: Jun. 6, 1983

[30] Foreign Application Priority Data

Jun. 10, 1982 [JP] Japan ..... 57-99747

[51] Int. Cl.[4] ..... H01B 3/24

[52] U.S. Cl. ..... 252/574; 252/49.8; 252/78.5; 252/580; 106/18.18; 106/18.19

[58] Field of Search ..... 252/49.8, 78.5, 574, 252/580; 106/18.18, 18.19

[56] References Cited

U.S. PATENT DOCUMENTS

| | | | |
|---|---|---|---|
| 3,308,207 | 3/1967 | Seil et al. | 252/78.5 |
| 3,428,715 | 2/1969 | West et al. | 252/78.5 |
| 3,773,866 | 11/1973 | Baker et al. | 252/78.5 |
| 4,053,941 | 10/1977 | Shimizu et al. | 252/574 |
| 4,163,731 | 8/1979 | Randell et al. | 252/574 |
| 4,234,696 | 11/1980 | Birum et al. | 106/18.19 |

*Primary Examiner*—Paul Lieberman
*Assistant Examiner*—Robert A. Wax
*Attorney, Agent, or Firm*—Ostrolenk, Faber, Gerb & Soffen

[57] ABSTRACT

A flame-retardant electrical insulating oil composition comprising 100 parts by volume of the insulating oil and 5 to 80 parts by volume a halogen-containing phosphoric ester.

12 Claims, No Drawings

FLAME-RETARDANT ELECTRICAL INSULATING OIL COMPOSITION

BACKGROUND OF THE INVENTION

The present invention relates to a flame-retardant electrical insulating oil composition.

In the past, as a flame-retardant electrical insulating oil, a polybiphenyl chloride was employed, but after its use was forbidden from the viewpoint of environmental pollution, a silicone oil, an $SF_6$ gas or the like has instead been utilized in, for example, vehicular or indoor transformers in which dangers of fires should be avoided. Further, it has also been suggested to employ, in a transformer or a capacitor, an insulating oil with which a phosphoric ester is mixed. However, these materials are expensive and their uses are limited due to their quality. Therefore it is now desired to develop a nonflammable or a flame-retardant insulating oil which is better in performance.

As a result of intensive research, the inventors of the present case have succeeded in developing an insulating oil excellent in flame-retardant properties and without impairing any quality inherent in the insulating oil, by adding a small amount of a halogen-containing phosphoric ester to the insulating oil.

SUMMARY OF THE INVENTION

The present invention relates to an electrical insulating composition which is prepared by adding 5 to 80 parts by volume, preferably 10 to 40 parts by volume, of a halogen-containing phosphoric ester to 100 parts by volume of an insulating oil.

DETAILED DESCRIPTION OF THE INVENTION

A halogen-containing phosphoric ester which will be used in the present invention is a compound represented by the following formula:

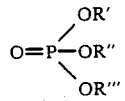

in which R', R'' and R''' are residues of halogenated hydrocarbons each including 1 to 3 halogen atoms and having 1 to 12 carbon atoms, preferably 1 to 8 carbon atoms and may be different or identical. Further, R'' and R''' may be residues of hydrocarbons each having 1 to 12 carbon atoms. It is preferred in particular in the present invention that R', R'' and R''' are the same, and it is also preferable that a selected halogen is fluorine, chlorine or bromine. Examples of the aforesaid halogenated hydrocarbon residues include $-CH_2X$, $-CH_2CH_2X$, $-CH(CH_3)CH_2X$, $-CH(CH_3)CHX_2$, $-C_6H_4CH_2X$ and $-C_6H_4CHX_2$, where X represents a halogen.

The phosphoric esters including halogens, which can be preferably used in the present invention, include tris(dichloroisopropyl)phosphate, tris(chloroethyl)phosphate and tris(monochlorophenyl)phosphate.

The insulating oil which can be used as a base in the present invention may be either insulating oil of a synthetic oil such as alkylbenzene, diarylalkane, alkyldiphenyl, alkylnaphthalene or dibenzyltoluene and a mineral oil.

The electrical insulating oil composition according to the present invention can be applied as an impregnating agent for an insulating paper and/or a plastic film which is a consitutional requirement of an electric applicance. If desired, it is possible to add, to the oil composition, a phenol antioxidant such as di-tert-butyl-p-cresol, an amine antioxidant such as phenol-α-naphthylamine, an additive such as benzotriazole or an epoxy compound, for example, an epoxy fatty monoester, a glycidylether epoxy compound, an aromatic epoxy compound or an epoxy vegetable oil.

Now, the present invention will be described with reference to examples, but they are not intended to restrict the present case.

EXAMPLE 1

To 85 parts by volume of diarylalkane, 15 parts by volume of tris(chloroethyl)phosphate were added (Nisseki Condenser Oil S which was manufactured by Nippon Oil Co., Ltd. was used as the diarylalkane). With regard to the resultant composition, its properties and combustion rate according to JIS C2101 testing method were measured, and obtained results are set forth in Table 1 below.

EXAMPLE 2

To 80 parts by volume of the diarylalkane, 20 parts by volume of tris(dichloroisopropyl)phosphate were added. Results regarding the resultant composition are also set forth in Table 1.

COMPARATIVE EXAMPLE 1

Results in the case that the diarylalkane was used alone are also set forth in Table 1.

COMPARATIVE EXAMPLE 2

To 60 parts by volume of the diarylalkane, 40 parts by volume of tricresyl phosphate were added. Obtained results are also set forth in Table 1.

TABLE 1

| | Example 1 | Example 2 | Comparative Example 1 | Comparative Example 2 |
|---|---|---|---|---|
| Viscosity (40° C.) (cSt) | 5.8 | 8.5 | 5.1 | 8.5 |
| Flash point (°C.) | 156 | 158 | 150 | 162 |
| Permittivity (80°) | 3.4 | 3.6 | 2.5 | 4.2 |
| Dielectric dissipation factor (80° C.) (%) | 0.6 | 0.9 | 0.02 | 3.8 |
| Combustion rate (mm/sec) | 0 | 2.1 | 5.1 | 3.2 |
| Hydrogen gas absorption* (mm oil) | −180 | −168 | −199 | −148 |

*Technical Data No. 6 (1967) of Electrical Insulating Oil Research Meeting; a value at 150 minutes - a value at 50 minutes As shown in the above results, the phosphoric esters including the halogens used in Examples 1 and 2 can contribute to a flame retardant resistance in a much smaller amount, as compared with the phosphoric ester used in Comparative Example 2 above. Particularly in the case of Example 1 where the tris(chloroethyl)phosphate was used, the combustion rate is zero and its addition amount as small as 15% by volume.

As understood from the foregoing, the halogen-including phosphoric ester used in the present invention can show a noticeable effect when employed in a small amount, and therefore it has a little influence on properties of the insulating oil.

What is claimed is:

1. A flame retardant electrical insulating oil composition comprising 100 parts by volume of the insulating oil and 5 to 80 parts by volume of a halogen-containing phosphoric ester of the formula

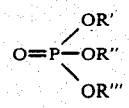

in which R', R'' and R''' are residues of halogenated hydrocarbon wherein said halogenated hydrocarbon residue is $—CH_2X$, $—CH_2CH_2X$, $—CH(CH_3)CH_2X$, $—CH(CH_3)CHX_2$, $—C_6H_4CH_2X$ or $—C_6H_4CHX_2$, where X represents a halogen atom.

2. A flame-retardant electrical insulating oil composition according to claim 1 wherein said insulating oil is a synthetic oil selected from the group consisting of alkylbenzene, diarylalkane, alkyldiphenyl, alkylnaphthalene and dibenzyltoluene.

3. A flame-retardant electrical insulating oil composition according to claim 1 wherein said insulating oil is a mineral oil.

4. A flame-retardant electrical oil composition according to claim 5 wherein the halogen is chlorine.

5. A flame-retardant electrical oil composition according to claim 1 wherein R', R'' and R''' are the same.

6. A flame-retardant electrical insulating oil composition according to claim 4 wherein said halogen-containing phosphoric ester is tris(dichloroisopropyl)phosphate, tris(chloroethyl)phosphate or tris(monochlorophenyl)phosphate.

7. A flame-retardant electrical oil composition according to claim 4 wherein said ester is 10 to 40 parts per 100 parts of the oil.

8. A flame-retardant electrical oil composition according to claim 7 wherein the oil is a diarylalkane.

9. A flame-retardant electrical oil composition according to claim 8 wherein the ester is 15 to 20 parts per 80 to 85 parts of the oil.

10. A flame-retardant electrical oil composition according to claim 1 wherein said ester is 10 to 40 parts per 100 parts of the oil.

11. A flame-retardant electrical oil composition according to claim 10 wherein the oil is diarylalkane.

12. A flame-retardant electrical oil composition according to claim 11 wherein the ester is 15 to 20 parts per 80 to 85 parts of the oil.

* * * * *